US011708132B2

(12) United States Patent
Ganzinga et al.

(10) Patent No.: US 11,708,132 B2
(45) Date of Patent: Jul. 25, 2023

(54) MOORING ASSEMBLY AND VESSEL PROVIDED THEREWITH

(71) Applicant: Bluewater Energy Services B.V., Hoofddorp (NL)

(72) Inventors: Willem Sievert Ganzinga, Beverwijk (NL); Johannes Cornelis Perdijk, Voorburg (NL)

(73) Assignee: BLUEWATER ENERGY SERVICES B.V., Hoofddorp (NL)

( * ) Notice: Subject to any disclaimer, the term of this patent is extended or adjusted under 35 U.S.C. 154(b) by 544 days.

(21) Appl. No.: 16/772,696

(22) PCT Filed: Dec. 14, 2017

(86) PCT No.: PCT/EP2017/082796
§ 371 (c)(1),
(2) Date: Jun. 12, 2020

(87) PCT Pub. No.: WO2019/114966
PCT Pub. Date: Jun. 20, 2019

(65) Prior Publication Data

US 2020/0324862 A1 Oct. 15, 2020

(51) Int. Cl.
*B63B 21/50* (2006.01)
*B63B 22/02* (2006.01)

(52) U.S. Cl.
CPC ..... *B63B 21/508* (2013.01); *B63B 22/02* (2013.01); *B63B 2022/028* (2013.01)

(58) Field of Classification Search
CPC .. B63B 21/508; B63B 22/02; B63B 2022/028
See application file for complete search history.

(56) References Cited

U.S. PATENT DOCUMENTS 5,893,333 A * 4/1999 Smedal ..... B63B 22/026 441/4
5,957,074 A 9/1999 de Baan et al.
(Continued)

FOREIGN PATENT DOCUMENTS

EP 1803641 A1 * 7/2007 ..... B63B 21/508
GB 2354219 A1 3/2001
(Continued)

OTHER PUBLICATIONS

International Search Report dated Aug. 28, 2018, for corresponding International Patent Application No. PCT/EP2017/082796, filed Dec. 14, 2017.
(Continued)

*Primary Examiner* — S. Joseph Morano
*Assistant Examiner* — Jovon E Hayes
(74) *Attorney, Agent, or Firm* — Steven M. Koehler; Westman, Champlin & Koehler, P.A.

(57) ABSTRACT

A mooring assembly for a vessel includes a turret with a lower receptacle cone receiving a buoy, mooring lines attached to the buoy, and risers. The buoy includes a plurality of pivot legs positioned on a lower part of the buoy, wherein the legs are pivotably connected to the buoy through a horizontally extending pivot axis to pivot in a radial plane with respect to the buoy between a first position with the buoy in the cone of the turret, in which the legs extend mainly vertically downwards and engage an inner surface of the cone, and a second position with the buoy outside of the cone, in which the legs extend mainly horizontally outwards. The lines are attached to the legs and each leg has such a length that in the first position its end is located at a level below the lowermost end of the cone.

17 Claims, 4 Drawing Sheets

(56) References Cited

U.S. PATENT DOCUMENTS

| | | | | |
|---|---|---|---|---|
| 6,457,536 | B1 * | 10/2002 | Bye | B63B 21/507 175/7 |
| 7,510,452 | B2 * | 3/2009 | Van Tol | B63B 22/026 441/5 |
| 9,422,035 | B2 | 8/2016 | Bauduin et al. | |
| 10,059,409 | B2 | 8/2018 | Hoogeveen et al. | |
| 10,160,522 | B2 | 12/2018 | Lisland et al. | |
| 2011/0162571 | A1 * | 7/2011 | Hooper | B63B 21/508 114/230.12 |
| 2015/0034002 | A1 * | 2/2015 | Bauduin | B63B 21/507 114/230.12 |
| 2016/0101831 | A1 | 4/2016 | Hoogeveen et al. | |
| 2016/0368573 | A1 * | 12/2016 | Lisland | E21B 19/004 |

FOREIGN PATENT DOCUMENTS

| | | | | |
|---|---|---|---|---|
| GB | 2484031 A * | 3/2012 | | B63B 21/507 |
| WO | 9614238 A1 | 5/1996 | | |
| WO | WO-9614238 A1 * | 5/1996 | | B63B 22/026 |
| WO | 9630253 A1 | 10/1996 | | |
| WO | WO-9630253 A1 * | 10/1996 | | B63B 21/508 |
| WO | WO-2009031971 A1 * | 3/2009 | | B63B 21/507 |
| WO | 2013110807 A1 | 8/2013 | | |
| WO | 2015063262 A1 | 5/2015 | | |
| WO | 2016057455 A1 | 4/2016 | | |
| WO | WO-2019114966 A1 * | 6/2019 | | B63B 21/508 |

OTHER PUBLICATIONS

Written Opinion of the International Searching Authority dated Aug. 28, 2018, for corresponding International Patent Application No. PCT/EP2017/082796, filed Dec. 14, 2017.

* cited by examiner

MOORING ASSEMBLY AND VESSEL PROVIDED THEREWITH

CROSS-REFERENCE TO RELATED APPLICATION

The present application is a national stage of International patent application Serial No. PCT/EP2017/082796, filed Dec. 14, 2017, and published in English as WO 2019/114966.

BACKGROUND

The discussion below is merely provided for general background information and is not intended to be used as an aid in determining the scope of the claimed subject matter.

In a first aspect the invention relates to a mooring assembly for a vessel of the type comprising a turret which is intended to be rotatably mounted to the vessel in a manner that the vessel can weathervane around the turret, which turret is provided with a lower receptacle cone, further comprising a buoy which in a disconnectable manner is received in the receptacle cone, mooring lines attached to the buoy and intended to be anchored to stationary anchor points, such as for example mooring piles, and risers connecting to and extending through the buoy which have upper ends intended to be connected to lower ends of turret piping through riser connections when the buoy is received in the receptacle cone of the turret.

A main field of use of such a mooring assembly is the handling of oil and gas. The vessel may comprise a ship or other type of floating facility for, among others, (temporarily) storing, processing and/or transferring oil and/or gas. Using the combination of a buoy and turret allows the vessel to weathervane around the buoy for assuming an optimal position depending on the environmental conditions (such as, for example, current and wind). The buoy can be disconnected from the turret such that the vessel can move to another location. In some instances the buoy may be of a so-called quick-disconnect type allowing a quick disconnect (for example when a storm approaches the site). The receptacle cone of the turret and the buoy generally have mating tapering shapes making a connection operation easy and fast to carry out. The mooring lines keep the buoy (and thus also the vessel) substantially at a desired position. The risers define the pathways for the transport of oil and/or gas.

When such a mooring assembly will be used in deep water, the mooring lines (and often also the risers) define catenary shapes (sometimes in combination with buoyant bodies). As a result any interference between the mooring line and the vessel can be avoided and the weight of the catenary is used for controlling and correcting the position of the vessel. However, in shallow water the formation of such catenary shapes is not possible in an effective manner, such that there is a risk of interference between the mooring lines and the vessel.

SUMMARY

A mooring assembly includes a buoy provided with a plurality of pivot legs regularly positioned on a lower part of the buoy, wherein the pivot legs each at a first leg end are pivotably connected to the buoy through a horizontally extending pivot axis in such a manner that the pivot legs can pivot in a radial plane with respect to the buoy between an first position, when the buoy is received in the receptacle cone of the turret, in which the pivot legs extend mainly vertically downwards and engage an inner surface of the receptacle cone, and a second position, when the buoy is positioned outside of the receptacle cone of the turret, in which the pivot legs extend mainly horizontally outwards from the buoy, and wherein the mooring lines are attached to a respective opposite second leg end of the pivot legs, and wherein each pivot leg has such a length that in the first position its second end is located at a level below the lowermost end of the receptacle cone.

The mooring lines now may be tensioned such that they become taut without the risk that they will interfere with the vessel, because the mooring lines are attached to said second ends of the pivot legs which are located at a level sufficiently low. Because, however, the pivot legs will pivot outwards to a substantially horizontal position when the buoy is disconnected (this means when the buoy is lowered relative to the receptacle cone of the turret), it can be prevented that the pivot legs will contact the sea bed and thus will hinder or prevent the buoy from moving downwards sufficiently for allowing the vessel to move away. The tension in the mooring lines automatically causes the outward pivoting movement of the pivot legs from the first position to the second position when the buoy is lowered. When the buoy is again received in and connected to the receptacle cone of the turret, the receptacle cone will engage the pivot legs and will move these to the first position. Thus any additional drive mechanism for the movement of the pivot legs is not necessary (but may be provided as an additional feature if needed). The buoy may be of a non-floating type which, once disconnected from the turret, sinks automatically (for example onto the sea bed) and which can be lifted again into the receptacle cone by a winch assembly (as known per se in this field).

In one embodiment the pivot legs are connected to a lower face of the buoy wherein in the first position the pivot legs extend in line with an outer surface of the buoy.

The expression "in line with" basically means that the buoy and pivot legs define a substantially continuous outer shape without steps (apart from any gaps between these parts). As a result the pivot legs do not disturb the optimal engagement between the buoy and the receptacle cone.

In another embodiment the receptacle cone defines at least one cone bearing member intended for cooperation with at least one vessel bearing member for supporting the turret in the vessel wherein each pivot leg in its first position engages the receptacle cone at a level corresponding with the level where the cone and vessel bearing members cooperate.

As a result mooring forces from the mooring lines introduced in the pivot legs will be transferred from the pivot legs to the receptacle cone and from the receptacle cone to the vessel in a direct line, thus optimising the design and function. The cooperating cone bearing member and vessel bearing member may be of a sliding bearing type using a single or a plurality of sliding block members running on an overlay (as known per se in this field).

In yet another embodiment the receptacle cone has an inner surface comprising planar surface sections wherein the pivot legs have outer planar surfaces which in the first position of the pivot legs engage the planar surface sections of the receptacle cone.

Such planer sections assure the provision of a sufficiently large contact surface between the pivot legs (which for a simple construction generally also will have a planar outer face) and the receptacle cone, avoiding high local load concentrations.

For example the inner surface of the receptacle cone is shaped as a regular polygon, preferably a 6-sided regular polygon.

It is noted that the buoy also may have a corresponding polygonal shape.

In one embodiment of the mooring assembly the buoy also carries at least one riser support arm supporting the risers which is pivotably connected to the buoy through a horizontally extending pivot axis in such a manner that the riser support arm can pivot between an first position, when the buoy is received in the receptacle cone of the turret, in which the riser support arm extends mainly vertically downwards and engages the inner surface of the receptacle cone, and a second position, when the buoy is positioned outside of the receptacle cone of the turret, in which the riser support arm extends mainly horizontally outwards from the buoy.

The use and function of such a riser support arm corresponds with those of a pivot leg, but now with respect to a riser. Generally the riser support arm in its first position also will extend below the lowermost part of the receptacle cone.

It is conceivable that the turret is intended to be mounted internally in a moonpool of a vessel. Such a moonpool generally is provided within the contour of the vessel's hull. As an alternative solution, however, it is possible that the turret is intended to be mounted externally in an outrigger of a vessel. Such an outrigger then is located outside of the (original) contour of the vessel's hull.

In the latter case an embodiment may be provided in which the outrigger comprises an upper outrigger part providing an upper main bearing for the turret and a lower outrigger part providing a vessel bearing member for cooperation with a cone bearing member.

Although such upper and lower outrigger parts may be combined into a single outrigger, it is also possible that they define separate parts (wherein, when the outrigger is intended to be positioned at the bow of a vessel, the lower outrigger part for example may be a forward prolongation of the lower bow section of the vessel).

In one embodiment of the mooring assembly the mooring lines over at least part of their length are surrounded by a protective tube, wherein the mooring lines are provided with a plurality of spaced floaters with an outer dimension less than an inner diameter of said protective tube.

The floaters assure that the mooring lines are positioned above the lowermost inner part (or lumen) of the tubes where sand or other material may collect, thus minimizing wear. The tubes further protect the mooring lines against sand, mud or rocks, and also against sun light, thus minimizing fouling of the mooring lines (for example because of marine growth).

The protective tubes may be sealed at their opposite ends, and the sealed interior may be filled with a conditioned fluid.

Mud mats may be installed underneath the tubes for additional protection.

In one embodiment the mooring lines have a first end connected to a respective pivot leg and an opposite second end connected to a chain section cooperating with a chain tensioner wherein the mooring lines preferably are made of polyester.

Using the chain section with chain tensioner the mooring lines may be tensioned as desired at a location sufficiently far away from the vessel (in some instances the mooring lines have a length of about 1000 meters) and thus under safe conditions.

In yet another embodiment the mooring assembly comprises disconnectable locks acting between the turret and the buoy, wherein the mooring assembly is dimensioned and constructed such that said locks as well as the riser connections between the upper ends of the risers and the lower ends of the turret piping are located at a level above sea level, as considered in a situation when the mooring assembly is used on a vessel which is in an operationally ballasted configuration.

Thus these locks and riser connections are readily accessible, for example for inspection or maintenance.

In one embodiment the risers extend between the buoy and a stationary pipe line end manifold and are divided into two riser sections meeting each other at a junction at an angle different from 180° wherein a spring member with a first end engages said junction and with an opposite second end engages a stationary member, such as a mooring pile, for tensioning the riser sections, wherein the spring member extends in a direction for minimizing the risk of the risers touching the seabed or vessel when the buoy is received in the receptacle cone.

Mud mats may be installed underneath the risers for additional protection.

The angle at said junction may, for example, be 90° and the junction may be defined by an angled pipe segment defining said angle. The spring member may comprise a nylon or rubber cable. Additional support members for the spring member, for the purpose of keeping the system free from the seabed, may be provided which are positioned on the sea bed in the vicinity of the junction.

It is noted that generally the parts of the risers extending between the buoy (more specifically the riser support arms) and the stationary pipe line end manifold are supported by riser support cables extending between the buoy and the manifold, as is known per se. Thus, here the indication "riser section" may refer to a combination of a riser and such a riser support cable.

In a second aspect the present invention relates to a vessel provided with a mooring assembly in accordance with the present invention.

BRIEF DESCRIPTION OF THE DRAWINGS

Hereinafter the invention will be elucidated while referring to the drawings in which.

DETAILED DESCRIPTION OF THE ILLUSTRATIVE EMBODIMENT

Figure 1:
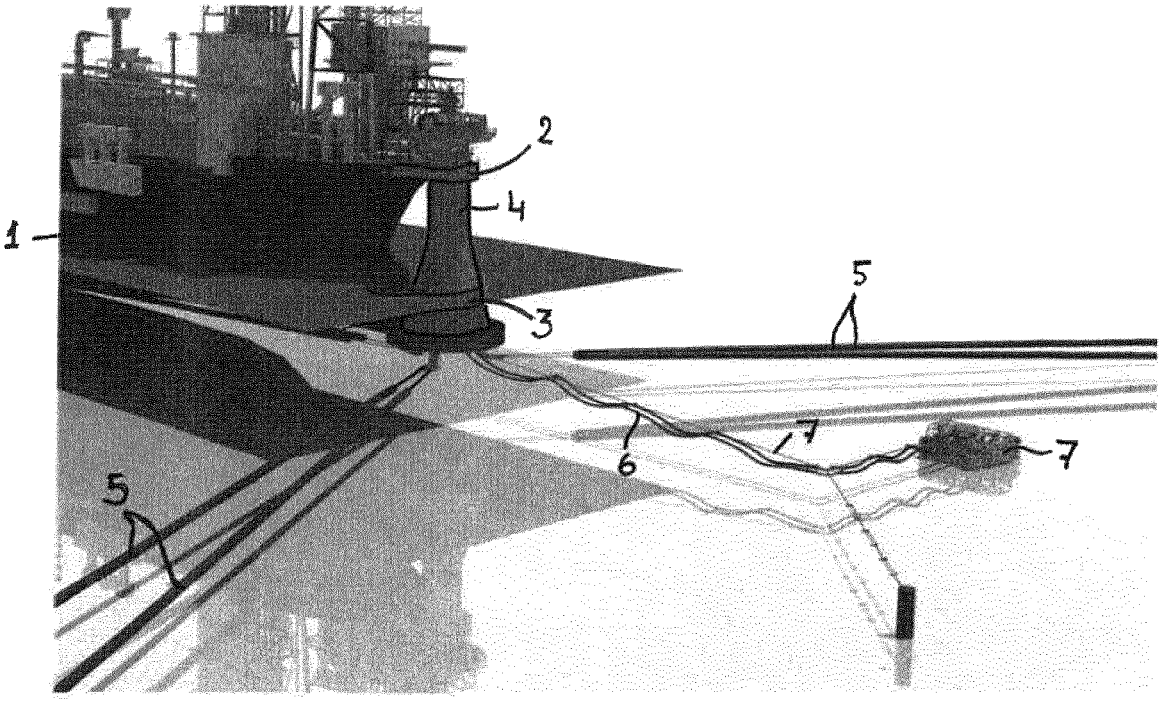
FIG. 1 illustrates the general lay-out of a mooring assembly.

Firstly referring to FIG. 1, part of a vessel 1 (for example a floating liquid natural gas—FLNG—vessel) is illustrated. At the bow of the vessel 1 an upper outrigger part 2 and a lower outrigger part 3 are provided. These outrigger parts 2,3 support an upper main bearing (not illustrated in detail) and a lower auxiliary bearing (to be explained later) for a turret 4 which (as is known per se) thus is externally mounted for a rotation relative to the upper and lower outrigger parts 2,3 and thus relative to the vessel 1. Or, in other words, the vessel 1 can weathervane around the turret 4.

The mooring assembly comprises said turret 4 and further components to be described below. Among these components are mooring lines 5 (for example made of polyester) anchored to stationary anchor points (such as mooring piles) and attached to a buoy (to be described later) which in a disconnectable manner is received in a lower part (a receptacle cone to be described below) of the turret 4 and risers 6 (for transferring oil and/or gas) which at one end connect to the buoy and at an opposite end are connected to a pipe line end manifold (PLEM) 7. The risers 6 are supported by riser support cables 7, as is known per se.

Figure 2:
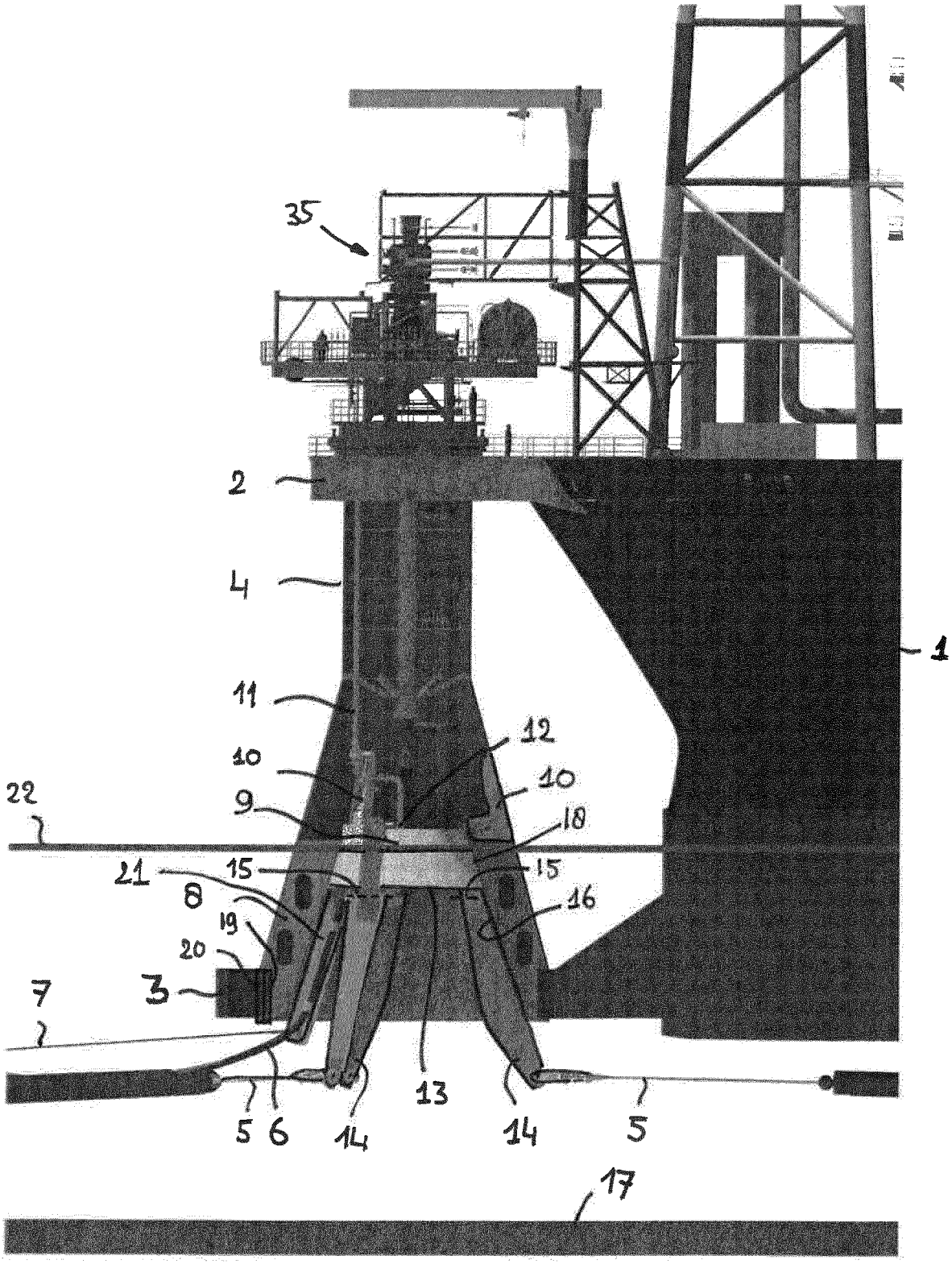
FIGS. 2 and 3 in a partly cut-away side elevational view illustrate the mooring assembly in two different positions.
Figure 3:
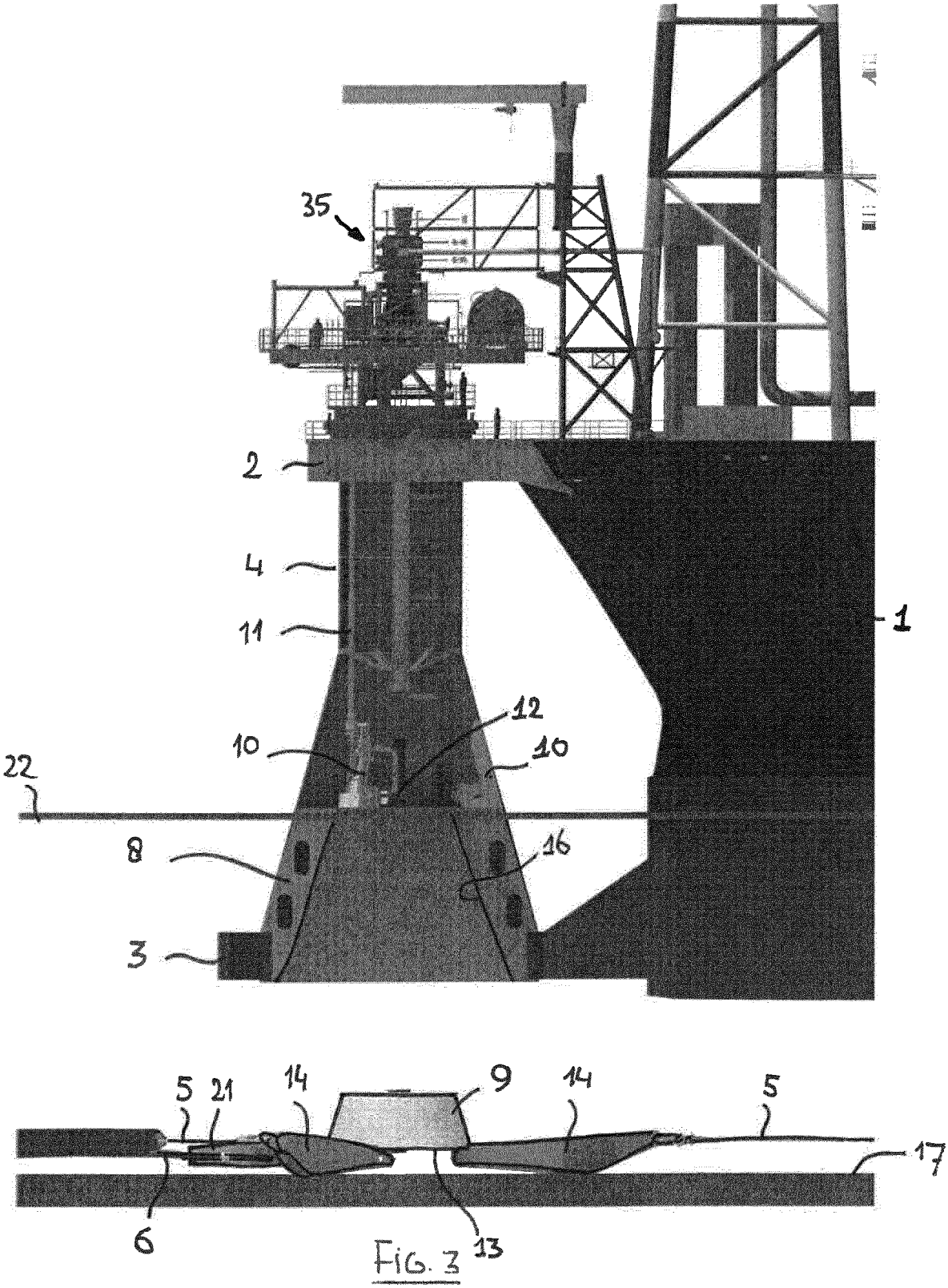

For a more detailed description of the mooring assembly, now reference is made to FIGS. 2 and 3 which illustrate the mooring assembly in two different positions and which illustrate the bow section of the vessel 1 with turret 4 and upper outrigger part 2 and lower outrigger part 3 in a partly cut-away manner to better show all components.

The lower part of the turret 4 defines a receptacle cone 8 within which a buoy 9 may be received in a disconnectable manner. The disconnectable connection between the buoy 9 and the receptacle cone 8 occurs through locks 10 known per se. The risers 6 extend through the buoy 9 and have upper ends (not shown in detail) intended to be connected to (lower ends of) turret piping 11 through riser connections 12. The turret piping 11 in a manner known per se connects to a swivel 35 which successively connects to piping on board of the vessel 1.

Figure 4:
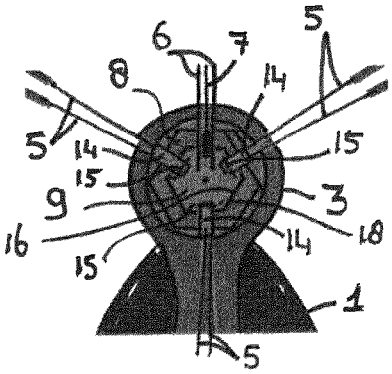
FIG. 4 illustrates a bottom view of the turret with buoy received in the receptacle cone.
Figure 5:
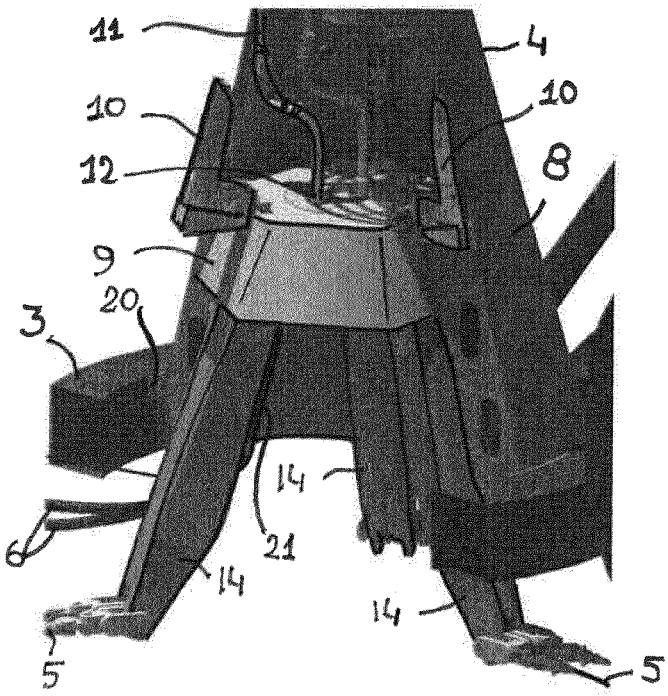
FIG. 5 illustrates a partly cut-away perspective view of a lower part of the mooring assembly.

On a lower face 13 of the buoy 9 three pivot legs 14 are regularly positioned (only two being visible in FIGS. 2 and 3, but all three being visible in FIGS. 4 and 5). These pivot legs 14 each at a first (upper) leg end are pivotably connected to the buoy 9 through a horizontally extending pivot axis 15 (illustrated in dotted lines in FIGS. 2 and 4) in such a manner that the pivot legs 14 can pivot in a radial plane with respect to the buoy 9 between a first position (FIG. 2), when the buoy 9 is received in the receptacle cone 8 of the turret 4, in which the pivot legs 14 extend mainly vertically downwards and engage an inner surface 16 of the receptacle cone 8 (the exact orientation of the pivot legs 14 thus being determined by said engagement between the pivot legs 14 and the inner surface 16 of the receptacle cone 8), and a second position (FIG. 3), when the buoy 9 is positioned outside of (and below) the receptacle cone 8 of the turret 4, in which the pivot legs 14 extend mainly horizontally outwards from the buoy 9.

The mooring lines 5 are attached to opposite (lower) ends of the pivot legs 14. The tension in the mooring lines 5 keeps the pivot legs 14 in the first position (FIG. 2) in engagement with the inner surface 16 of the receptacle cone 8, but also causes the pivot arms 14 to pivot to the second position (FIG. 3) when the locks 10 disconnect the buoy 9 and the buoy moves downwards out of the receptacle cone 8 and sinks onto the sea bed 17. In the first position the pivot legs 14 extend substantially in line with an outer surface 18 of the buoy 9 (which, as will be clear, will correspond with the inner surface 16 of the receptacle cone 8 such that a well-defined position of the buoy 9 inside the receptacle cone 8 is obtained).

The pivot legs 14 have such a length that in the first position their second ends where the mooring lines 5 connect, are located at a level below the lowermost end of the receptacle cone 8. This assures that the mooring lines 5 remain free from (the keel of) the vessel 1, also when latter weathervanes around the turret 4. Of course, the length of the pivot legs 14 further will be chosen such that they do not touch the sea bed 17 in the first position.

When the buoy 9 has lowered onto the sea bed 17 (FIG. 3) the pivot legs 14 also rest on the sea bed 17 and extend radially outward from the buoy (in this position the vessel 1 is disconnected from the buoy 9 and can move away). The tensioned mooring lines 5 keep the pivot legs 14 in such a (second) position until the buoy is picked up again (using a winch assembly—for example supported by the upper outrigger part 2—with hoisting cable which can be attached to the top of the buoy in a manner known per se) and is pulled in the receptacle cone 8 which then will engage the pivot legs 14 which then will pivot inwards to the first position again. The movement of the pivot legs from the first to the second position allows the use of such pivot legs also in shallow water. If the pivot legs 14 could not pivot to a horizontal position (second position), a total disconnect of the buoy 9 from the turret 4 could be problematic due to a lack of sufficient distance towards the sea bed 17.

Referring to FIG. 4 it appears that the receptacle cone 8 has an inner surface 16 shaped as a 6-sided regular polygon (other shapes being possible too, however), wherein each of the six sides defines a planar surface section for cooperation with outer planar surfaces of the pivot legs 14 when latter assume the first position. This assures the transmission of mooring loads over a large surface and prevents high local loads with the risk on deformations of or damage to the receptacle cone 8. The buoy likewise has an outer surface 18 shaped as a regular 6-sided polygon.

As illustrated in FIG. 2, the receptacle cone 8 defines a cone bearing member 19 (for example comprising a plurality of bearing blocks) intended for cooperation with at least one vessel bearing member 20 (part of the lower outrigger part 3 and for example comprising a continuous sliding ring or overlay, also visible in FIG. 5) for horizontally supporting the turret 4 in the lower outrigger part 3 of the vessel 1.

Each pivot leg 14 in its first position engages the receptacle cone 8 at a (horizontal) level corresponding with the level at which the cone and vessel bearing members 19,20 cooperate (which together define the above mentioned lower auxiliary bearing).

The buoy 9 also carries at least one riser support arm 21 supporting the risers 6 which likewise is pivotably connected to the buoy 9 through a horizontally extending pivot axis (not illustrated in detail) in such a manner that the riser support arm 21 can pivot between a first position (FIG. 2), when the buoy 9 is received in the receptacle cone 8 of the turret 4, in which the riser support arm extends mainly vertically downwards and engages the inner surface 16 of the receptacle cone 8 (and extends below the lowermost part of latter), and a second position (FIG. 3), when the buoy 9 is positioned outside of the receptacle cone 8 of the turret 4, in which the riser support arm 21 extends mainly horizontally outwards from the buoy. The function of such a riser support arm 21 is equivalent to that of a pivot leg 14, but with the difference that it supports a riser 6 and not a mooring line 5.

The embodiment of the mooring assembly described is dimensioned and constructed such that the locks 10 as well as the riser connections 12 between the upper ends of the risers 6 and the lower ends of the turret piping 11 are located at a level above sea level 22, as considered in a situation when the mooring assembly is used on a vessel 1 which is in an operationally ballasted configuration.

In an embodiment not illustrated, the outrigger with upper and lower outrigger parts 2, 3 could be replaced by a so-called moonpool within the outer contour of the hull of the vessel 1 in which the turret 4 is located in a manner known per se.

Figure 6:
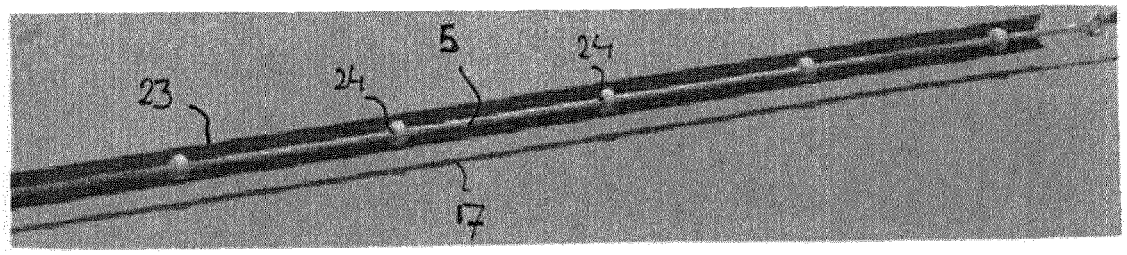
FIG. 6 illustrates part of a mooring line with partly cut-away protective tube.

As appears from FIG. 6, the mooring lines 5 over at least part of their length are surrounded by a protective tube 23. This can protect the mooring lines 5 against sun light and marine growth, but also against other influences, such as wear when the mooring lines 5 touch or rest on the sea bed 17. In the illustrated embodiment the mooring lines 5 further are provided with a plurality of spaced floaters 24 with an outer dimension less than an inner diameter of said protective tubes 23. Thus the mooring lines 5 float upwards towards the upper part of the protective tube lumen and remain free from the lower part thereof where sand or other material may accumulate. It is possible that the protective tubes 23 are sealed at their opposite ends (and then could have a conditioned environment within the inner lumen or cavity).

Figure 7:
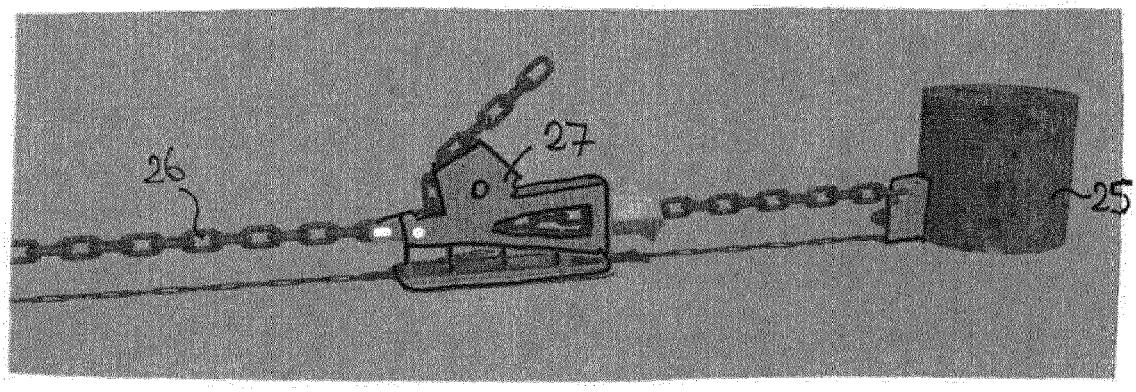
FIG. 7 illustrates a mooring line end with chain section and chain tensioner.

FIG. 7 shows an end of a mooring line 5 remote from the end connected to a respective pivot leg 14 of the buoy 9 which is attached to a stationary anchor point (such as a mooring pile 25 driven into the sea bed) through a chain section 26 cooperating with a chain tensioner 27.

Figure 8:
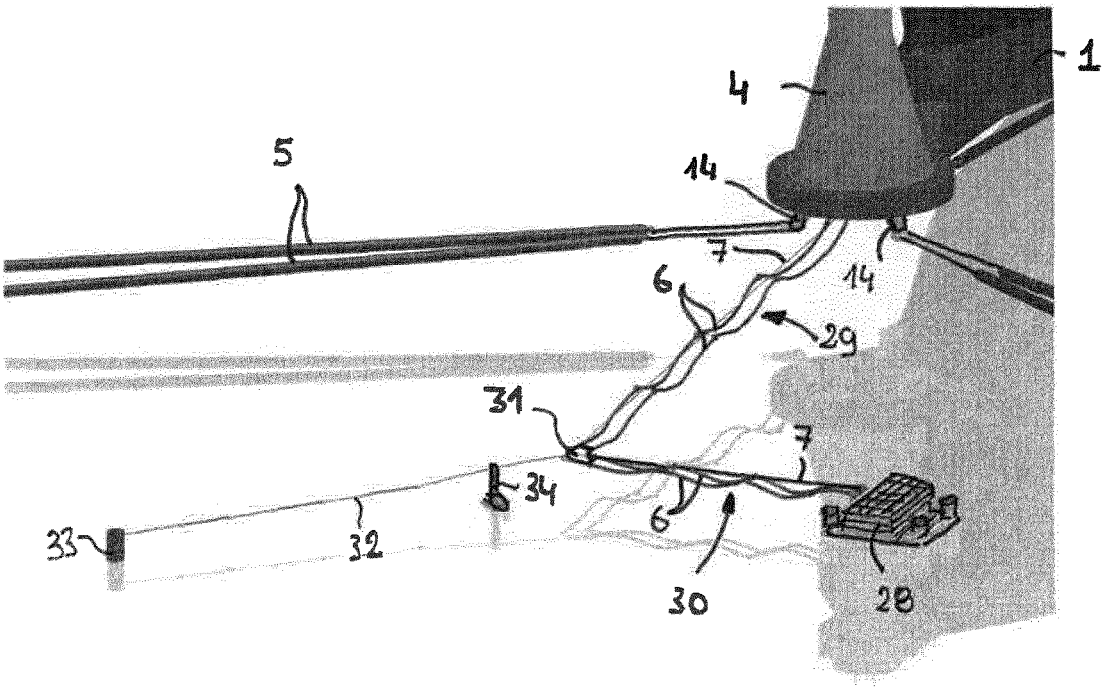
FIG. 8 illustrates a perspective view of a riser arrangement.

Finally referring to FIG. 8 an arrangement of risers is illustrated. The risers 6 extend between the buoy (not visible within the lower part of the turret 4) and a stationary pipe line end manifold 28. In this embodiment riser support cables 7 support the risers 6.

The risers 6 with riser support cables 7 are divided into two riser sections 29 and 30 meeting each other at a junction 31 at an angle different from 180° (in the illustrated embodiment the angle is about 90°). A spring member 32 (for example made of rubber or nylon) with a first end engages said junction 31 and with an opposite second end engages a stationary member, such as a mooring pile 33, for tensioning the riser sections. The spring member 32 extends in a direction for minimizing the risk of the risers 6 touching the seabed or vessel when the buoy 9 is received in the receptacle cone 8 of the turret 4. An additional support member 34 resting on the sea bed may be provided in the vicinity of the junction 31. The junction may comprise an angled pipe segment.

Such a riser arrangement aims at keeping the position of the risers 6 under control between the buoy 9 and the manifold 28 and is based on the tension of the spring member 32 for keeping the risers free from the sea bed 17 and free from the vessel in the described first position (buoy received in the receptacle cone).

The invention is not limited to the embodiments described which may be varied widely within the scope of the invention as defined by the appending claims.

The invention claimed is:

1. A mooring assembly for a vessel of the type comprising a turret which is intended to be rotatably mounted to the vessel in a manner that the vessel can weathervane around the turret, which turret is provided with a lower receptacle cone having a lowermost end, the mooring assembly comprising:

a buoy which in a disconnectable manner is received in the receptacle cone, the buoy comprising a plurality of pivot legs regularly positioned on a lower part of the buoy, wherein the pivot legs each at a first leg end are pivotably connected to the buoy through a horizontally extending pivot axis in such a manner that the pivot legs pivot in a radial plane with respect to the buoy between a first position, when the buoy is received in the receptacle cone of the turret, wherein each pivot axis is disposed on the buoy such that each pivot axis is located at a level above the lowermost end of the receptacle cone, in which first position the pivot legs extend mainly vertically downwards and engage an inner surface of the receptacle cone, and a second position, when the buoy is positioned outside of the receptacle cone of the turret and each pivot axis is located at a level below the lowermost end of the receptacle cone, in which second position the pivot legs extend mainly horizontally outwards from the buoy, and wherein each pivot leg has such a length that in the first position its second end is located at a level below the lowermost end of the receptacle cone;

mooring lines attached to the buoy and configured to be anchored to stationary anchor points, and wherein the mooring lines are attached to a respective opposite second leg end of the pivot legs; and risers connecting to and extending through the buoy which have upper ends configured to be connected to lower ends of turret piping through riser connections when the buoy is received in the receptacle cone of the turret.

2. The mooring assembly according to claim 1, wherein the pivot legs are connected to a lower face of the buoy and wherein in the first position the pivot legs extend in line with an outer surface of the buoy.

3. The mooring assembly according to claim 1, wherein the receptacle cone defines at least one cone bearing member configured to cooperate with at least one vessel bearing member for supporting the turret in the vessel and wherein each pivot leg in its first position engages the receptacle cone at a level corresponding with the level where the cone and vessel bearing members cooperate.

4. The mooring assembly according to claim 1, wherein the receptacle cone has an inner surface comprising planar surface sections and wherein the pivot legs have outer planar surfaces which in the first position of the pivot legs engage the planar surface sections of the receptacle cone.

5. The mooring assembly according to claim 4, wherein the inner surface of the receptacle cone is shaped as a regular polygon.

6. The mooring assembly according to claim 1, wherein the buoy also carries at least one riser support arm supporting the risers which is pivotably connected to the buoy through a horizontally extending pivot axis in such a manner that the riser support arm pivots between a first position, when the buoy is received in the receptacle cone of the turret, in which the riser support arm extends mainly vertically downwards and engages the inner surface of the receptacle cone, and a second position, when the buoy is positioned outside of the receptacle cone of the turret, in which the riser support arm extends mainly horizontally outwards from the buoy.

7. The mooring assembly according to claim 1, wherein the turret is configured to be mounted internally in a moonpool of a vessel.

8. The mooring assembly according to claim 1, wherein the turret is configured to be mounted externally in an outrigger of a vessel.

9. The mooring assembly according to claim 8, wherein the outrigger comprises an upper outrigger part providing an upper main bearing for the turret and a lower outrigger part providing a vessel bearing member for cooperation with a cone bearing member.

10. The mooring assembly according to claim 8, wherein the outrigger is configured to be positioned at the bow of a vessel.

11. The mooring assembly according to claim 1, wherein the mooring lines over at least part of their length are surrounded by a protective tube, wherein the mooring lines are provided with a plurality of spaced floaters with an outer dimension less than an inner diameter of said protective tube.

12. The mooring assembly according to claim 11, wherein the protective tubes are sealed at their opposite ends.

13. The mooring assembly according to claim 1, wherein the mooring lines have a first end connected to a respective pivot leg and an opposite second end connected to a chain section cooperating with a chain tensioner.

14. The mooring assembly according to claim 1, comprising disconnectable locks acting between the turret and the buoy, wherein the mooring assembly is dimensioned and constructed such that said locks as well as the riser connections between the upper ends of the risers and the lower ends of the turret piping are located at a level above sea level, as considered in a situation when the mooring assembly is used on a vessel which is in an operationally ballasted configuration.

15. The mooring assembly according to claim 1, wherein the risers extend between the buoy and a stationary pipe line end manifold and are divided into two riser sections meeting each other at a junction at an angle different from 180° and wherein a spring member with a first end engages said junction and with an opposite second end engages a stationary member for tensioning the riser sections, wherein the spring member extends in a direction for minimizing the risk of the risers touching the seabed or vessel when the buoy is received in the receptacle cone.

16. An assembly comprising:

a vessel with a turret rotatably mounted to a portion of the vessel in a manner that the vessel is configured to weathervane around the turret, the turret having a lower receptacle cone;

a mooring assembly comprising:

a buoy which in a disconnectable manner is received in the receptacle cone, the buoy comprising a plurality of pivot legs regularly positioned on a lower part of the buoy, wherein the pivot legs each at a first leg end are pivotably connected to the buoy through a horizontally extending pivot axis in such a manner that the pivot legs pivot in a radial plane with respect to the buoy between a first position, when the buoy is received in the receptacle cone of the turret, in which the pivot legs extend mainly vertically downwards and outward movement of each pivot leg is inhibited by a portion of each pivot leg below each associated pivot axis engaging an inner surface of the receptacle cone, and a second position, when the buoy is positioned outside of the receptacle cone of the turret, in which the pivot legs pivot and extend mainly horizontally outwards from the buoy, and wherein each pivot leg has such a length that in the first position with the portion engaging the inner surface of the receptacle cone its second end is located at a level below the lowermost end of the receptacle cone;

mooring lines attached to the buoy and configured to be anchored to stationary anchor points, and wherein the mooring lines are attached to a respective opposite second leg end of the pivot legs; and risers connecting to and extending through the buoy which have upper ends configured to be connected to lower ends of turret piping through riser connections when the buoy is received in the receptacle cone of the turret.

17. The mooring assembly according to claim 5, wherein the regular polygon is a 6-sided regular polygon.

* * * * *